US006613116B2

(12) United States Patent
Oh

(10) Patent No.: US 6,613,116 B2
(45) Date of Patent: Sep. 2, 2003

(54) GRILL ASSEMBLY OF CYCLONE DUST COLLECTING APPARATUS FOR VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/082,456

(22) Filed: Feb. 25, 2002

(65) Prior Publication Data

US 2003/0014953 A1 Jan. 23, 2003

(30) Foreign Application Priority Data

Jul. 19, 2001 (KR) ..... 2001-43285

(51) Int. Cl.[7] ..... B01D 45/12

(52) U.S. Cl. ..... 55/413; 55/417; 55/426; 55/459.1; 55/DIG. 3

(58) Field of Search ..... 55/413, 414, 417, 55/424, 426, 459.1, DIG. 3

(56) References Cited

U.S. PATENT DOCUMENTS 2,071,975 A * 2/1937 Holm-Hansen et al. ..... 55/413

* cited by examiner

*Primary Examiner*—Robert A. Hopkins
(74) *Attorney, Agent, or Firm*—Ladas & Parry

(57) ABSTRACT

A grill assembly of a cyclone dust collecting apparatus for a vacuum cleaner capable of preventing dust from being drawn to a vacuum-generating device even in a case that the vacuum cleaner operates when a sealing member is not assembled with a grill body. The grill assembly includes the grill body having a connecting passage connected with an air discharge passage of the cyclone dust collecting apparatus; a sealing member removably connected with the grill body in order to seal one opening of the grill body; and valve for sealing the connecting passage of the grill body when the sealing member is not assembled with the grill body.

8 Claims, 4 Drawing Sheets

GRILL ASSEMBLY OF CYCLONE DUST COLLECTING APPARATUS FOR VACUUM CLEANER

BACKGROUND OF THE INVENTION

1. Field of the Invention

The present invention relates to a cyclone dust collecting apparatus for a vacuum cleaner, and more particularly to a grill assembly of a cyclone dust collecting apparatus for a vacuum cleaner used for preventing dust from being drawn into a vacuum-generating device.

2. Description of the Related Art

FIG. 1 shows a conventional cyclone dust collecting apparatus for a vacuum cleaner. The illustrated cyclone duct collecting apparatus represents an earlier product of the present assignee, so that it cannot be used as the basis to deny the inventive step of the claims.

According to FIG. 1, the conventional cyclone dust collecting apparatus 10 for a vacuum cleaner comprises a cyclone body 20, a dust-collecting portion 30, and grill assembly 40. The grill assembly 40 is installed at the cyclone body 20 by a fastening member such as a screw (not shown).

An air suction passage 21 connected with a brush assembly (not shown) of the vacuum cleaner is disposed at an upper part of the cyclone body 20. Air drawn through the air suction passage 21 flows in a tangential direction along the cyclone body 20 and forms a whirling air current.

An air discharge passage 22 connected with a vacuum-generating device (not shown) of the vacuum cleaner is disposed at an upper central part of the cyclone body 20. In order to prevent filth from being drawn into the vacuum-generating device, the grill assembly 40 is disposed at an inlet of the air discharge passage 22.

The grill assembly 40 has a grill body 41 and a sealing member 42. The grill body 41 has a plurality of passages 46 formed therein in order to draw into an air. The sealing member 42 has a filth backflow prevent unit 43 formed at an outer part of a circumference thereof.

An upper part of the grill body 41 is connected with the air discharge passage 22 of the cyclone body 20, and a lower part of the grill body 41 is sealed by the sealing member 42. The sealing member 42 is connected with a bracket 44 by a screw 45, and the bracket 44 is integrally formed with the grill body 41.

In the conventional cyclone dust collecting apparatus 10 for a vacuum cleaner with the above construction, if the vacuum-generating device of the vacuum cleaner operates, the air containing various filth on a cleaning surface is drawn into the cyclone body 20 through the air suction passage 21.

The air drawn into the cyclone body 20 forms the whirling air current, and dust included in the air current is separated by a centrifugal force and collected in the dust collecting portion 30. The cleaned air flows to the vacuum-generating device through the passage 46 and the air discharge passage 22.

On the other hand, the sealing member 42 sometimes has to be separated from the grill body 41 to clean and repair the vacuum cleaner. After finishing the cleaning and repair, a user reassembles the sealing member 42 with the grill body 41.

There is a problem with this design in that the vacuum cleaner might be operated in a case that the sealing member 42 is not assembled with the grill body 41 due to the user's mistake. In this case, the dust is drawn into the vacuum-generating device through a lower opening of the grill body 41. Thus, an improvement to the present design would be desirable.

SUMMARY OF THE INVENTION

The present invention now provides a grill assembly of a cyclone dust collecting apparatus for a vacuum cleaner that is capable of preventing dust from being drawn to a vacuum-generating device even in the situation where the vacuum cleaner is operated when the sealing member is not assembled with the grill body.

The grill assembly of the cyclone dust collecting apparatus for a vacuum cleaner according to the present invention comprises a grill body having a connecting passage connected with an air discharge passage of the cyclone dust collecting apparatus; a sealing member removably connected with the grill body in order to seal one opening of the grill body; and valve means for sealing the connecting passage of the grill body when the sealing member is not assembled with the grill body.

In a preferred embodiment of the present invention, the valve means comprises a valve member disposed on the inside of the connecting passage and capable of moving between open and closed positions, preferably in upwardly and downwardly directions, and valve opening means for opening the connecting passage by driving the valve member to move it upwardly to the open position when the sealing member is assembled with the grill body.

In a more preferred embodiment of the present invention, the valve opening means comprises at least two valve opening pins protruding from an upper side of the sealing member. Optionally, means for urging the valve member downwardly toward the closed position may be included.

DETAILED DESCRIPTION OF THE PREFERRED EMBODIMENT

The preferred embodiment of the present invention will be described in great detail by referring to the appended drawings.

Figure 1:
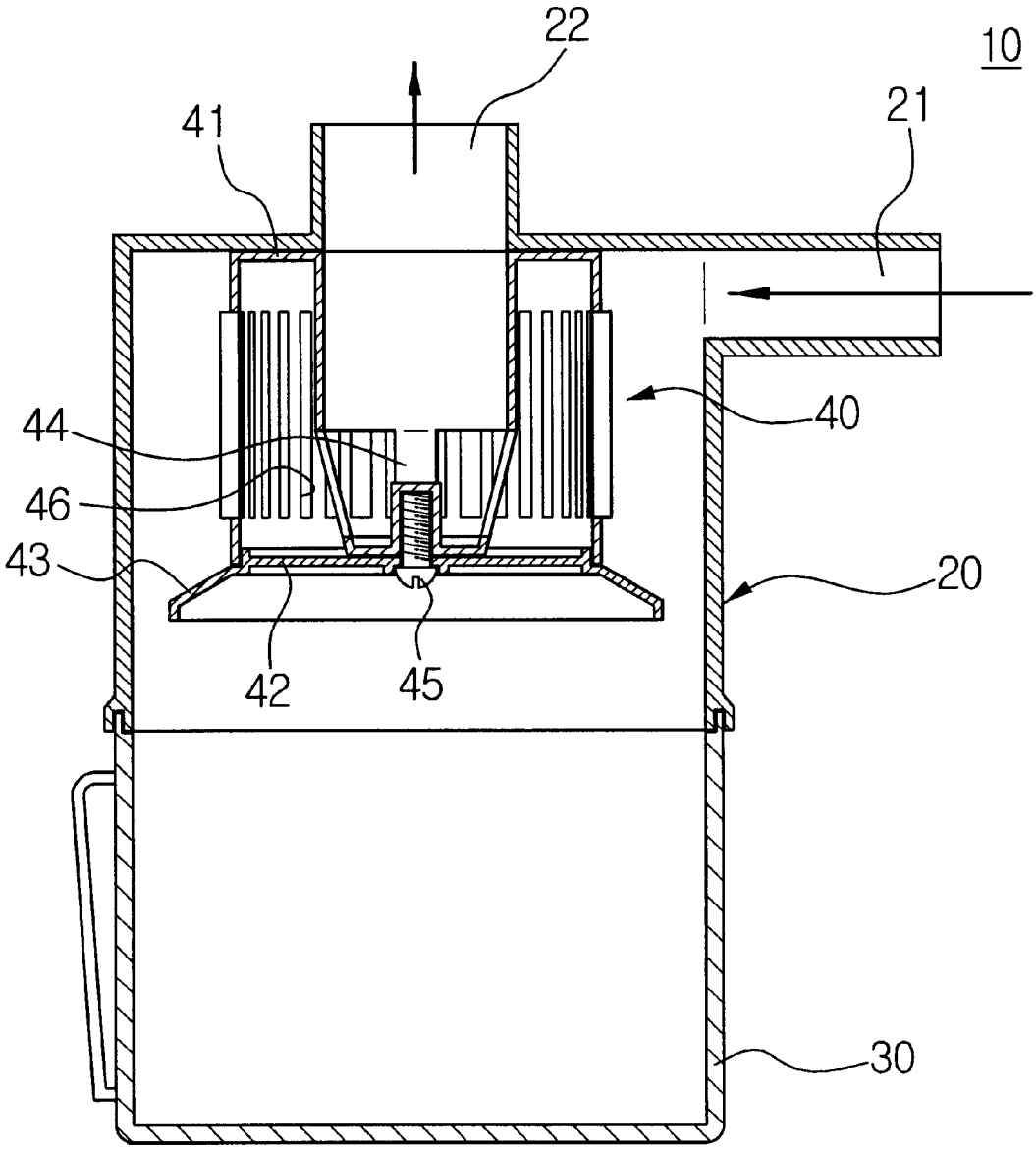
FIG. 1 is a sectional view showing a conventional dust collecting apparatus for a vacuum cleaner.
Figure 2:
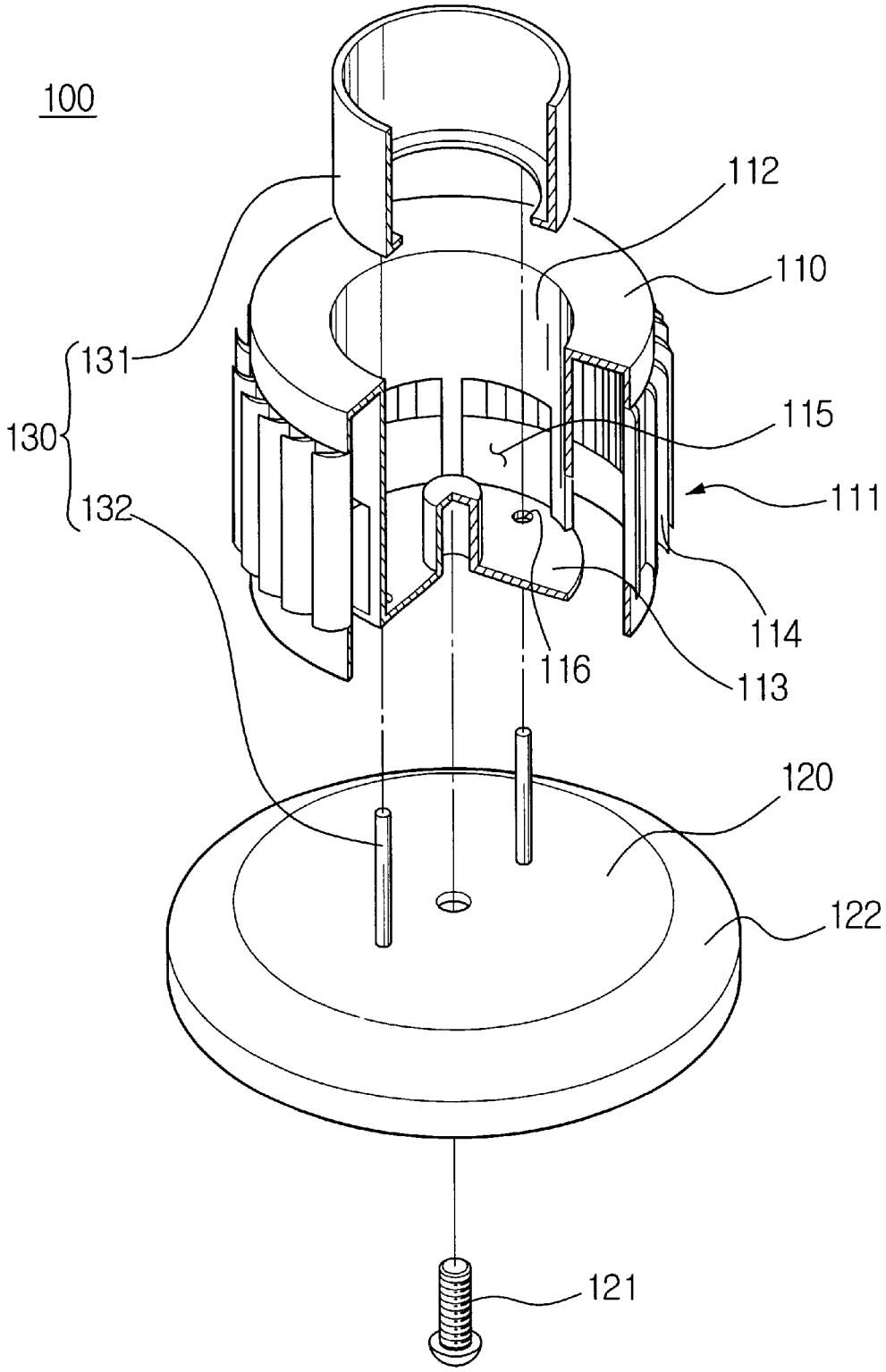
FIG. 2 is an exploded perspective view showing a grill assembly of a dust collecting apparatus for a vacuum cleaner according to the present invention.

FIG. 2 shows a grill assembly of a cyclone dust collecting apparatus for a vacuum cleaner according to the present invention. The grill assembly 100 of the cyclone dust collecting apparatus for a vacuum cleaner comprises a grill body 110, a sealing member 120, and valve means 130.

The grill body 110 has a grill unit 111, a connecting passage 112, and a sealing member connecting unit 113. The grill unit 111 has a plurality of passages having an appropriate type for preventing dust from being drawn into but securing that an air can be drawn into.

Figure 3:
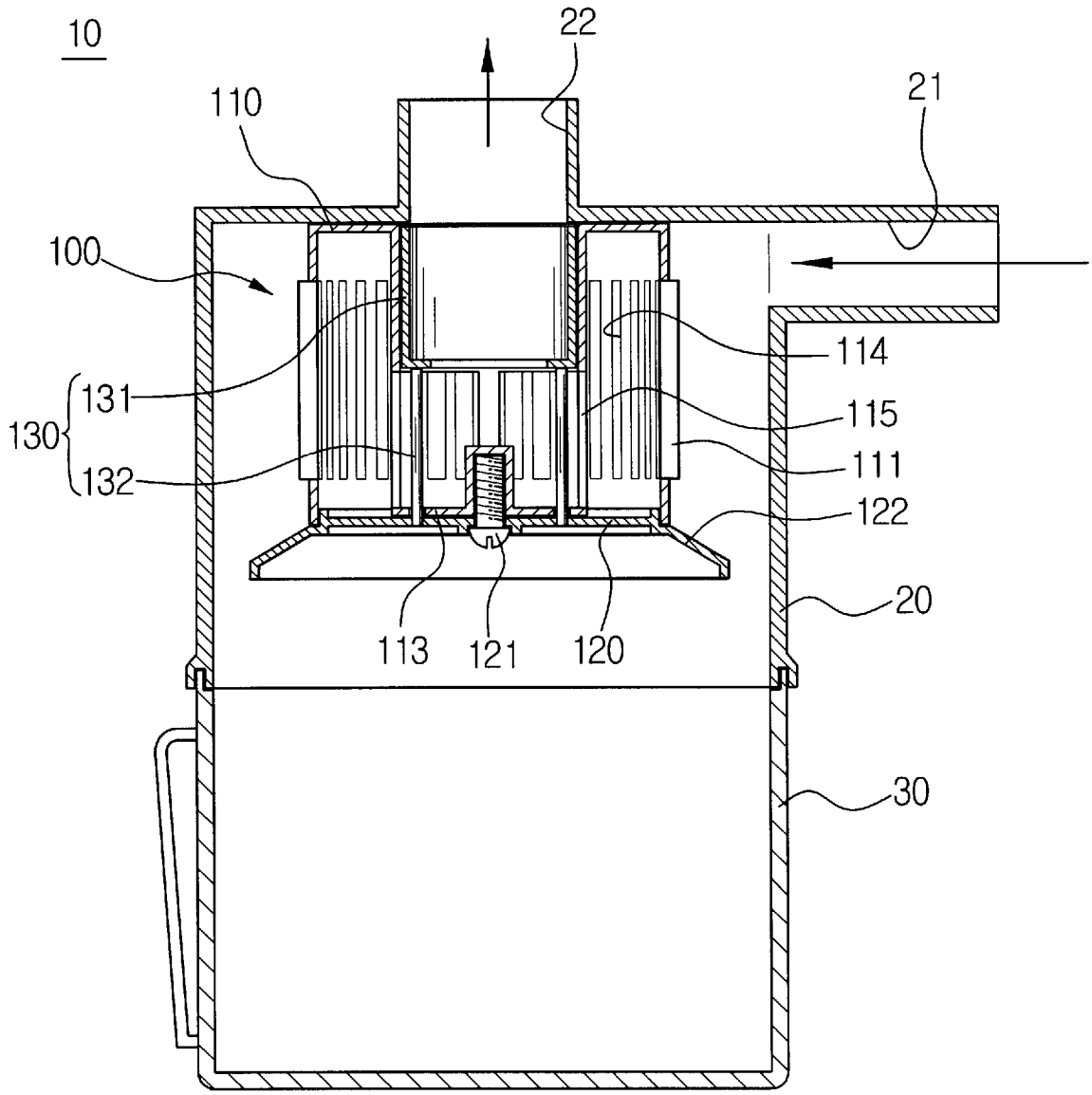
FIG. 3 is a sectional view showing the grill assembly of FIG. 2 being installed at a cyclone dust collecting apparatus.

The connecting passage 112 is disposed at a center of the grill body 110. As shown in FIG. 3, the connecting passage 112 is connected with an air discharge passage 22 of the cyclone dust collecting apparatus 10, when the grill assembly 100 is connected with the cyclone dust collecting apparatus 10.

An opening 115 is formed at a lower part of the connecting passage 112, and the air is drawn into the connecting passage 112 through the opening 115 after being drawn into through the passage 114 of the grill unit 114. The sealing member connecting unit 113 is disposed at a lower end of the connecting passage 112.

A lower opening of the grill body 110 is sealed by the sealing member 120. The sealing member 120 is connected with the sealing member connecting unit 113 by a screw 121. In other words, the sealing member 120 can be separated from the grill body 110 by simply removing the screw 121.

A filth backflow prevent unit 122 is disposed at an outer circumference of the sealing member 120. The filth backflow prevent unit 122 shifts a direction included in an air current towards the grill body 110 towards the whirling air current of the cyclone dust collecting apparatus 10.

The valve means 130 includes a valve member 131 and valve opening means. The valve member 131 is disposed inside of the connecting passage 112 and is capable of moving between open and closed position, preferably in upwardly and downwardly directions. In some cases, means for urging the valve member 131 downwardly toward the closed position may be included. The urging means is preferably gravity or a flexible member, such as a spring, which presses downwardly on the valve member 131.

The valve opening means comprises a pair of valve opening pins 132 protruded from an upper side of the sealing member 120, and a penetrating hole 116 is formed corresponding to the sealing member connecting unit 113 so that the valve opening pin 132 can pass therethrough.

FIG. 3 shows a cyclone body 20 having the grill assembly 100 with the above construction. The grill assembly 100 is removably connected with the cyclone body 20 by fastening means such as a screw.

On the other hand, a user can easily separate the sealing member 120 from the grill body 110 by pulling down the sealing member 120 after unscrewing the screw 121 when the user needs to separate the sealing member 120 from the grill body 110 in order to clean and repair the vacuum cleaner.

Figure 4:
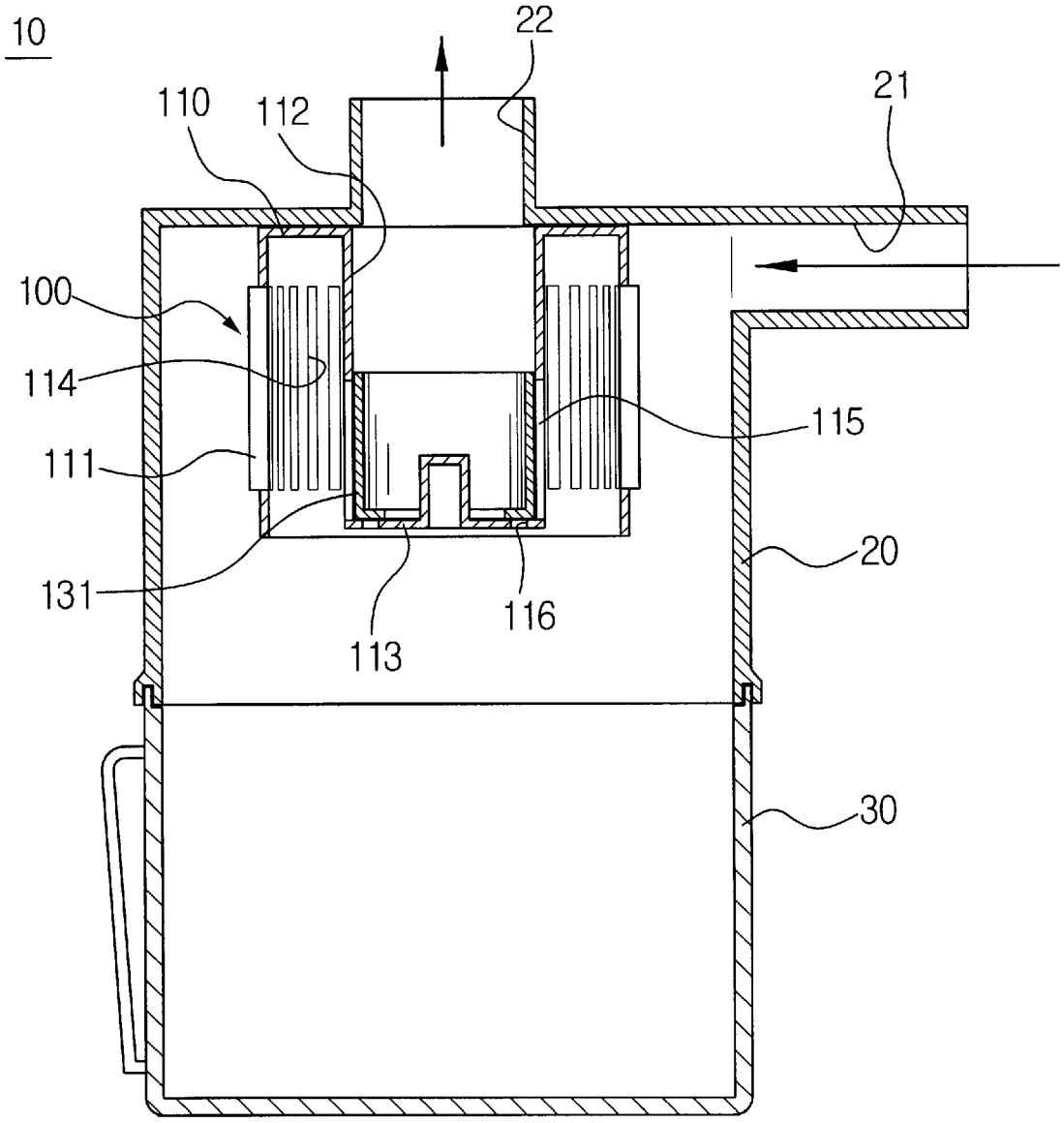
FIG. 4 is a sectional view showing a grill body not having the sealing member of the grill assembly of FIG. 3.

Accordingly, the valve opening pin 132 holding the valve member 131 is removed, and thus, as shown in FIG. 4, the opening 115 of the connecting passage 112 is sealed after the valve member 131 moves downwardly due to gravity or a pressing force provided by a flexible member.

In other words, since the opening 115 of the connecting passage 112 is sealed by the valve member 131, the dust cannot be drawn into the vacuum-generating device even though the vacuum cleaner is operated due to the user's mistake.

In the meantime, as shown in FIG. 3, when the sealing member 120 is reassembled with the grill body 110 after the cleaning or repair is finished, the valve member 131 is moved upwardly to the open position by the action of the valve opening pin 132, and the opening 115 of the connecting passage 112 is reopened.

Therefore the grill assembly of the cyclone dust collecting apparatus for a vacuum cleaner according to the present invention can prevent dust from being drawn into the vacuum-generating device when the vacuum cleaner operates even though the sealing member 120 is not assembled with the grill body 110.

So far, the preferred embodiment of the present invention has been illustrated and described. However, the present invention is not limited to the preferred embodiment described herein, and one of ordinary skill in the art can modify the present invention without departing from the true spirit and scope of the present claims.

What is claimed is:

1. A grill assembly of a cyclone dust collecting apparatus for a vacuum cleaner, comprising:

a grill body having a connecting passage for connecting with an air discharge passage of the cyclone dust collecting apparatus;

a sealing member removably connected with the grill body in order to seal one opening of the grill body; and valve member for opening and closing the connecting passage of the grill body in association with connecting and disconnecting of the sealing member.

2. The grill assembly of claim 1, wherein the valve member is disposed inside the connecting passage and is capable of moving between open and closed position.

3. The grill assembly of claim 2, wherein valve member moves between the open and closed positions in upwardly and downwardly directions.

4. The grill assembly of claim 2, further comprising means for urging member toward the closed position.

5. The grill assembly of claim 4 wherein the urging means includes gravity or a flexible member.

6. A vacuum cleaner comprising a cyclone dust collecting apparatus that includes a grill assembly according to claim 1.

7. The grill assembly of claim 2 further comprising valve opening means connected to the sealing member for opening the connecting passage by driving the valve member to the open position when the sealing member is assembled with the grill body.

8. The grill assembly of claim 7, wherein the valve opening means includes at least two valve opening pins protruded from an upper side of the sealing member.

* * * * *